US007376382B2

(12) United States Patent
Shibata

(10) Patent No.: US 7,376,382 B2
(45) Date of Patent: May 20, 2008

(54) IMAGE FORMING APPARATUS AND IMAGE FORMING METHOD

(75) Inventor: Kyoichi Shibata, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 242 days.

(21) Appl. No.: 11/015,500

(22) Filed: Dec. 16, 2004

(65) Prior Publication Data

US 2006/0132814 A1 Jun. 22, 2006

(51) Int. Cl.
*G03G 15/00* (2006.01)

(52) U.S. Cl. ..... 399/401; 399/402; 271/186

(58) Field of Classification Search ..... 399/401; 271/186

See application file for complete search history.

(56) References Cited

U.S. PATENT DOCUMENTS 4,116,558 A * 9/1978 Adamek et al. ..... 355/24
4,140,387 A * 2/1979 Gustafson ..... 399/364
4,209,249 A * 6/1980 Clark et al. ..... 399/374
4,650,313 A * 3/1987 Koike ..... 399/402
4,956,678 A * 9/1990 Kiya et al. ..... 399/401
4,990,941 A * 2/1991 Kawai ..... 347/153
5,079,598 A * 1/1992 Kaneko et al. ..... 399/364
5,132,742 A * 7/1992 Goto ..... 399/401
5,204,716 A * 4/1993 Kasahara et al. ..... 355/24
5,381,220 A * 1/1995 Acquaviva et al. ..... 399/367
5,966,556 A * 10/1999 Nakagawa et al. ..... 399/18
6,424,365 B1 * 7/2002 Kimoto ..... 347/129
6,539,198 B2 * 3/2003 Miyajima ..... 399/389
6,611,352 B2 * 8/2003 Suzuki et al. ..... 358/1.18
6,836,632 B2 * 12/2004 Miyasaka et al. ..... 399/162
2005/0251286 A1 * 11/2005 Yasui ..... 700/230

* cited by examiner

*Primary Examiner*—Ren Yan
*Assistant Examiner*—Matthew Marini
(74) *Attorney, Agent, or Firm*—SoCal IP Law Group LLP; Steven C. Sereboff; John E. Gunther

(57) ABSTRACT

In an image forming apparatus that uses a stackless ADU and executes image formation on both sides of a paper sheet in a facedown mode, a CPU confirms, when double-side image formation is to be executed with two paper sheets, image formation on reverse surfaces of which is finished, being stayed in the ADU, whether monochromatic image formation or color image formation is to be executed on an obverse surface of a first paper sheet that is stayed in the ADU and has a reverse surface on which image formation is finished. When the color image formation is to be executed, the CPU controls the image formation on the obverse surface of the first paper sheet that is stayed in the ADU and has the reverse surface on which image formation is finished. When the monochromatic image formation is to be executed, the CPU controls the image formation on a reverse surface of a second paper sheet that is stayed in the ADU.

2 Claims, 3 Drawing Sheets

IMAGE FORMING APPARATUS AND IMAGE FORMING METHOD

BACKGROUND OF THE INVENTION

1. Field of the Invention

The present invention relates to an image forming apparatus such as a printer, which has a stackless ADU and can execute black-and-white or color 2-sided printing.

2. Description of the Related Art

In the prior art, in general, when 2-sided printing is performed using a stackless ADU, alternate circulation of paper sheets is executed if the paper sheets are of short size. Thereby, a decrease in performance is minimized. In the alternate circulation, a path length that can retain two or more short-size paper sheets is secured in the ADU. Two sheets are first fed into the ADU, and then alternate printing is performed between the ADU and the sheet-supply side.

In the 2-sided printing, when color printing requires four rotations of transfer (e.g. revolver-type 4-color transfer), a subsequent paper sheet stays in the ADU for a long time in the alternate circulation.

The upper part of the ADU, however, is located just above the heat roller of a fixing device. Moisture in the paper sheet that stays in the ADU is lost due to the heat of the heat roller. When printing is effected on the paper sheet that comes from the ADU, good secondary transfer of toner could not be performed and toner would disperse.

BRIEF SUMMARY OF THE INVENTION

The object of an aspect of the present invention is to provide an image forming apparatus and an image forming method, which can form images with good conditions on both a reverse surface and an obverse surface of a paper sheet.

According to an aspect of the present invention, there is provided an image forming apparatus that uses a stackless ADU and executes image formation on both sides of a paper sheet in a facedown mode, comprising: confirmation means for confirming, when double-side image formation is to be executed with two paper sheets, image formation on reverse surfaces of which is finished, being stayed in the ADU, whether monochromatic image formation or color image formation is to be executed on an obverse surface of a first paper sheet that is stayed in the ADU and has a reverse surface on which image formation is finished; first control means for controlling, when the confirmation means confirms the color image formation to be executed, the image formation on the obverse surface of the first paper sheet that is stayed in the ADU and has the reverse surface on which image formation is finished; and second control means for controlling, when the confirmation means confirms the monochromatic image formation to be executed, the image formation on a reverse surface of a second paper sheet that is stayed in the ADU.

According to another aspect of the present invention, there is provided an image forming method for an image forming apparatus that uses a stackless ADU and executes image formation on both sides of a paper sheet in a face-down mode, comprising: confirming, when double-side image formation is to be executed with two paper sheets, image formation on reverse surfaces of which is finished, being stayed in the ADU, whether monochromatic image formation or color image formation is to be executed on an obverse surface of a first paper sheet that is stayed in the ADU and has a reverse surface on which image formation is finished, controlling, when the color image formation is to be executed, the image formation on the obverse surface of the first paper sheet that is stayed in the ADU and has the reverse surface on which image formation is finished; and controlling, when the monochromatic image formation is to be executed, the image formation on a reverse surface of a second paper sheet that is stayed in the ADU.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of an aspect of the invention.

DETAILED DESCRIPTION OF THE INVENTION

An embodiment of the present invention will now be described with reference to the accompanying drawings.

Figure 1:
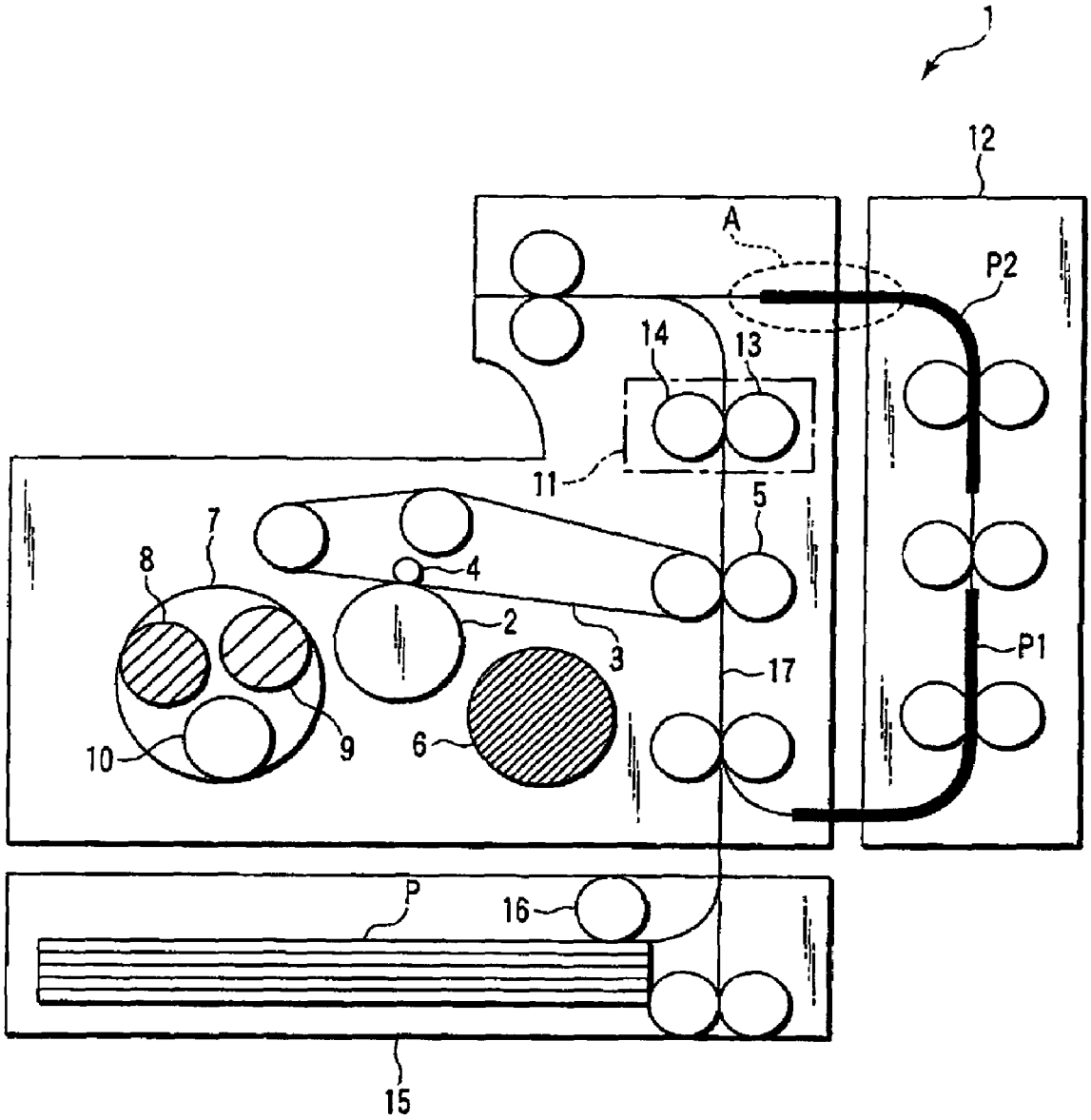
FIG. 1 is a cross-sectional view that schematically shows the structure of an image forming apparatus 1 according to the present invention.

FIG. 1 is a cross-sectional view that schematically shows the structure of an image forming apparatus 1 according to the present invention. The image forming apparatus 1 comprises a photoconductor body 2, an intermediate transfer belt 3, a primary transfer roller 4, a secondary transfer roller 5, a black developing device 6, a developing unit 7, a fixing device 11, an ADU 12 and a sheet feed unit 15.

The developing unit 7 is of a revolver type and includes a cyan developing device 8, a magenta developing device 9 and a yellow developing device 10. Two-component electrophotography developers, which are formed of cyan, magenta and yellow toners and magnetic carriers, are contained in the respective developing devices 8, 9 and 10.

The fixing device 11 includes a heat roller 13 and a press roller 14 and fixes the respective color toners that have been secondary-transferred on a paper sheet P.

Paper sheets P in the sheet feed unit 15 are picked up by a pickup roller 16 one by one and are conveyed along a convey path 17.

Figure 2:
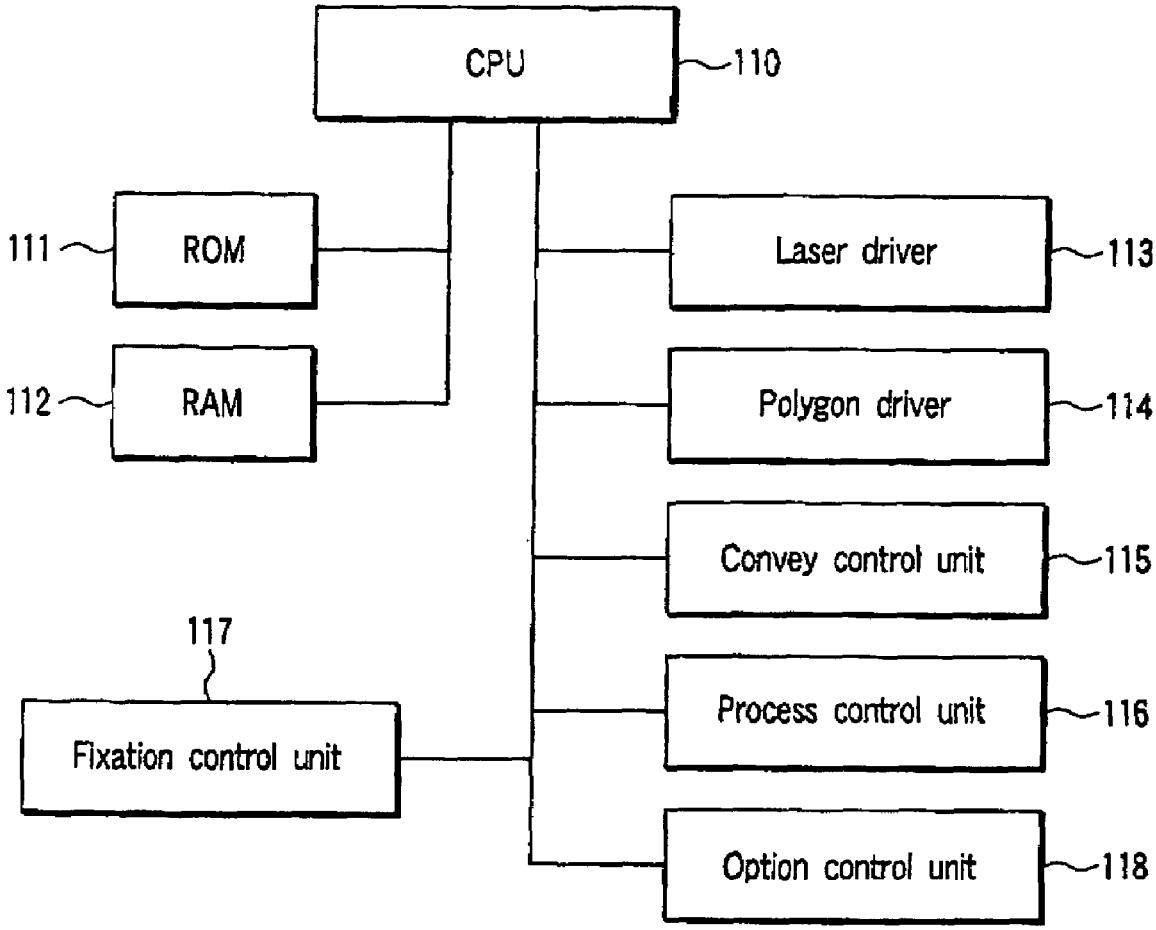
FIG. 2 is a block diagram that schematically shows the structure of a control system of the image forming apparatus 1.

FIG. 2 schematically shows the structure of a control system of the image forming apparatus 1.

The image forming apparatus 1 comprises a CPU 110 that executes an overall control, a ROM 111 that stores a control program, etc., a RAM 112 for data storage, a laser driver 113 that drives a semiconductor laser of a laser optical system (not shown), a polygon motor driver 114 that drives a polygon motor (not shown), a convey control unit 115 that controls conveyance of paper sheets P, a process control unit 116 that controls a process for charging, development and transfer, using a charger (not shown), a developing roller and a transfer device, a fixation control unit 117 that controls the fixing device 11, and an option control unit 118 that controls the ADU 12.

Next, the image forming operation by the control of the CPU 110 in the above-described structure is described.

To start with, the surface of the photoconductor body 2 is substantially uniformly charged, and an electrostatic latent image is formed on the photoconductor body 2 by a laser beam that is emitted in accordance with yellow image information. The yellow developing device 10 is rotated and brought to a position facing the photoconductor body 2, and develops the electrostatic latent image on the photoconductor body 2. The photoconductor body 2 rotates and conveys the developed toner image to a primary transfer region. The toner image on the photoconductor body 2 is transferred to the intermediate transfer belt 3 by a transfer bias that is applied by the primary transfer roller 4 from the back side of the intermediate transfer belt 3.

The intermediate transfer belt 3 has a circumferential length that corresponds to a length of an integer number of images. First-color toner images of the integer number of images are formed on the intermediate transfer belt 3. For example, if the belt 3 has a circumferential length that is greater than the vertical length of an A3-size sheet, i.e. 43 cm, the length corresponds to the horizontal length of two A4-size sheets. Two A4-size images are formed over the full circumferential length of the intermediate transfer belt 3.

Then, the developing unit 7 is rotated by 120° and the subsequent magenta developing device 9 is opposed to the photoconductor body 2. In addition, the surface of the photoconductor body 2 is substantially uniformly charged, and an electrostatic latent image is formed on the photoconductor body by a laser beam that is emitted in accordance with magenta image information. The magenta developing device 9 develops the electrostatic latent image on the photoconductor body 2. The magenta image on the photoconductor body 2 is registered with the yellow image on the intermediate transfer belt 3, and the magenta image is transferred over the yellow image.

Thereafter, the developing unit 7 is rotated by 120°, and the subsequent cyan developing device 8 is opposed to the photoconductor body 2. In addition, the surface of the photoconductor body 2 is substantially uniformly charged, and an electrostatic latent image is formed on the photoconductor body by a laser beam that is emitted in accordance with cyan image information. The cyan developing device 8 develops the electrostatic latent image on the photoconductor body 2. The cyan image on the photoconductor body 2 is registered with the yellow and magenta images on the intermediate transfer belt 3, and the cyan image is transferred over the yellow and magenta images.

Next, the surface of the photoconductor body 2 is substantially uniformly charged, and an electrostatic latent image is formed on the photoconductor body by a laser beam that is emitted in accordance with black image information. The black developing device 7 develops the electrostatic latent image on the photoconductor body 2. The black image on the photoconductor body 2 is registered with the yellow image on the intermediate transfer belt 3, and the black image is transferred thereon.

Thus, four-color overlapped toner images, which correspond to the integer number of images, are formed on the intermediate transfer belt 3.

A paper sheet P is fed to the convey path 17 from the paper feed unit 15 at a predetermined timing. At a secondary transfer position where the intermediate transfer belt 3 faces the convey path 17, the four-color toner image is transferred at a time on the paper sheet P by the secondary transfer roller 5.

The paper sheet P, on which the four-color toner image is transferred, is conveyed along the convey path 17 into the fixing device 11. The toner image is fixed by heat and pressure in the fixing device 11.

When 2-sided printing is to be effected on the paper sheet P, the paper sheet P is reversed and conveyed to the ADU 12.

In the ADU 12 shown in FIG. 1, a sheet P1 and a subsequent sheet P2, on which reverse-side printing is finished, stay and stand by for obverse-side printing.

In the structure shown in FIG. 1, a portion A of the subsequent sheet P2 is strongly affected by heat from the heat roller 13 of the fixing device 11. If the sheet P stays for a long time, moisture of the portion A would be lost. In this case, toner is not satisfactorily secondary-transferred at the time of obverse-side printing and is dispersed, as mentioned above.

As will be described later in detail, when color printing is effected on the obverse surface of the preceding sheet P1, the subsequent sheet P2 stays at the portion A for a long time. This is because a four-color overlapped toner image needs to be formed on the intermediate transfer belt 3, as mentioned above.

In the present embodiment, when color printing is to be effected on the obverse surface of the paper sheet, the sheet is circulated in a single-sheet circulation mode and printing is executed. Thereby, the subsequent sheet P2 is prevented from being thermally affected by the heat roller 13 during the four-color batch-transfer. Specifically, in facedown printing using the stackless ADU 12, 2-sided printing is performed in the order of a reverse surface and an obverse surface of the sheet. When the printing on the reverse surface of the sheet is executed, page information of the obverse surface of the sheet of the preceding page number is already input. Thus, the above-described determination is possible.

Even in the case where color printing is effected on the obverse surface of the sheet, alternate circulation is enabled at the time of reverse-side printing and a decrease in throughput is reduced.

Moreover, even where monochromatic printing is executed on the obverse surface, printing is executed without interruption and no thermal effect is caused. Thus, alternate circulation is performed.

Figure 3:
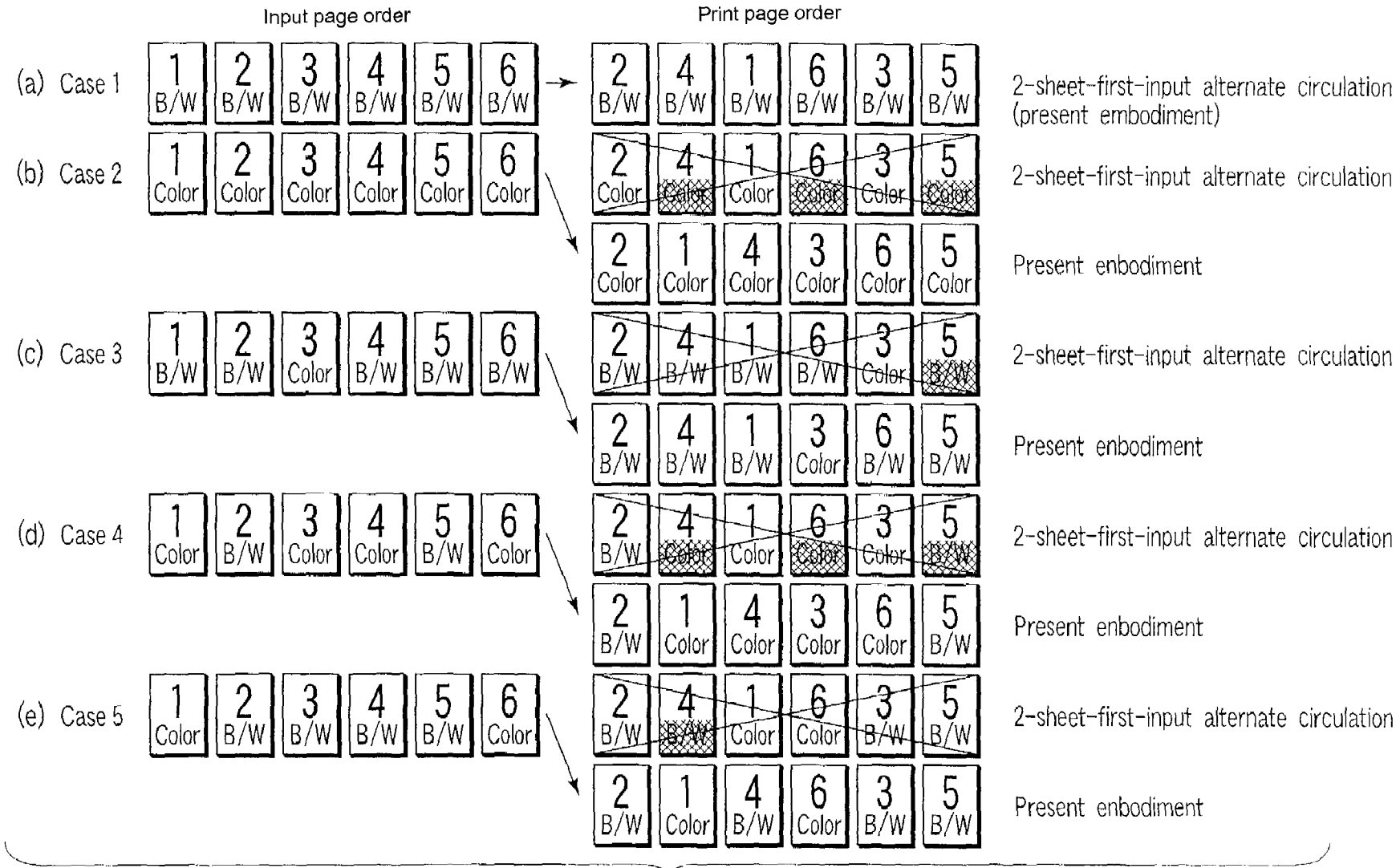
FIG. 3 is a view for explaining the image forming operation of the present embodiment.

Next, referring to FIG. 3, a description is given of an image forming operation by the control of the CPU 110 of the embodiment with the above-described structure. In FIG. 3, the image forming operation is compared with a prior-art image forming operation in order to make it easy to understand the embodiment.

The input page order in each of cases 1 to 5 (parts (a) to (e) in FIG. 3) is determined as follows. Number 1 indicates the obverse surface of a first page, number 2 indicates the reverse surface of the first page, number 3 indicates the obverse surface of a second page, number 4 indicates the reverse surface of the second page, number 5 indicates the obverse surface of a third page, number 2 indicates the reverse surface of the third page. In FIG. 3, "B/W" indicates a monochromatic page with monochromatic printing, and "Color" indicates a color page with color printing.

In case 1 (part (a)), the print page order is as follows. The reverse surface 2 of the first page is first printed, following which the reverse surface 4 of the second page is printed. In this case, the first-page sheet P, on the reverse surface of which printing is finished, and the second-page sheet P, on the reverse surface of which printing is finished, are stayed in the ADU 12. Subsequently, the obverse surface 1 of the first page is printed. Since monochromatic printing is to be effected on the obverse surface 1 of the first page, the time in which the obverse surface 1 stays in the ADU 12 is short. In this case, no thermal effect is caused by the heat roller 13 of the fixing device 11.

Following the printing of the obverse surface 1 of the first page, printing is successively executed on the reverse surface 6 of the third page, the obverse surface 3 of the second page, and at last the obverse surface 5 of the third page.

The above printing operation is a "2-sheet-first-input alternate circulation" mode.

In case 2 (part (b)), the obverse surface 1 of the first page, the reverse surface 2 of the first page, the obverse surface 3 of the second page, the reverse surface 4 of the second page, the obverse surface 5 of the third page and the reverse surface 6 of the third page are all color pages.

If the conventional 2-sheet-first-input alternate circulation printing is executed in this input page order, the reverse surface 4 of the second page, the reverse surface 6 of the third page and the obverse surface 5 of the third page are thermally affected by the heat roller 13 of the fixing device 11, leading to defective printing.

On the other hand, according to the control of the CPU 110 of the present embodiment, the reverse surface 2 of the first page is first printed. Since the obverse surface 1 of the first page is a color page, color printing is then executed on the obverse surface 1 of the first page. Subsequently, the reverse surface 4 of the second page is printed. Since the obverse surface 3 of the second page is a color page, color printing is then executed on the obverse surface 3 of the second page. Then, the reverse surface 6 of the second page is printed. Since the obverse surface 5 of the third page is a color page, color printing is then executed on the obverse surface 5 of the third page.

With this control, even when the printing is executed in the input page order of case 2, occurrence of a defective print page is prevented.

In case 3 (part (c)), only the obverse surface 3 of the second page is a color page, and the other pages are monochromatic pages.

If the conventional 2-sheet-first-input alternate circulation printing is executed in this input page order, the obverse surface 5 of the third page is thermally affected by the heat roller 13 of the fixing device 11, leading to defective printing.

On the other hand, according to the control of the CPU 110 of the present embodiment, the reverse surface 2 of the first page is first printed, following which the reverse surface 4 of the second page and the obverse surface 1 of the first page are printed in succession. In this embodiment, since the obverse surface 3 of the second page is a color page, color printing is then executed on the obverse surface 3 of the second page. As a result, no paper sheet P remains in the ADU 12. Therefore, no thermal effect is caused by the heat roller 13 of the fixing device 11.

Subsequently, the reverse surface 6 of the third page is printed, and at last the obverse surface 5 of the third page is printed.

With this control, even when the printing is executed in the input page order of case 3, occurrence of a defective print page is prevented.

In case 4 (part (d)), the obverse surface 1 of the first page, the obverse surface 3 of the second page, the reverse surface 4 of the second page and the reverse surface 6 of the third page are color pages. The reverse surface 2 of the first page and the obverse surface 5 of the third page are monochromatic pages.

If the conventional 2-sheet-first-input alternate circulation printing is executed in this input page order, the reverse surface 4 of the second page, the reverse surface 6 of the third page and the obverse surface 5 of the third page are thermally affected by the heat roller 13 of the fixing device 11, leading to defective printing.

By contrast, according to the control of the CPU 110 of the present embodiment, the reverse surface 2 of the first page is first printed. Since the obverse surface 1 of the first page is a color page, color printing is then executed on the obverse surface 1 of the first page. Subsequently, the reverse surface 4 of the second page is printed. Since the obverse surface 3 of the second page is a color page, color printing is then executed on the obverse surface 3 of the second page. Thereafter, the reverse surface 6 of the third page is printed, and at last the obverse surface 5 of the third page is printed.

With this control, even when the printing is executed in the input page order of case 4, occurrence of a defective print page is prevented.

In case 5 (part (e)), the obverse surface 1 of the first page and the reverse surface 6 of the third page are color pages, and the other pages are monochromatic pages.

If the conventional 2-sheet-first-input alternate circulation printing is executed in this input page order, the reverse surface 4 of the second page is thermally affected by the heat roller 13 of the fixing device 11, leading to defective printing.

By contrast, according to the control of the CPU 110 of the present embodiment, the reverse surface 2 of the first page is first printed. Since the obverse surface 1 of the first page is a color page, color printing is then executed on the obverse surface 1 of the first page. Subsequently, the reverse surface 4 of the second page and the reverse surface 6 of the third page are printed. In this case, paper sheet P1 and paper sheet P2 are stayed in the ADU 12. However, since the obverse surface 3 of the second page is subjected to monochromatic printing, the time in which the sheet P2 stays in the ADU 12 is short. Therefore, no defective print page occurs.

Subsequently, the obverse surface 3 of the page 2 is printed, and at last the obverse surface 5 of the page 3 is printed.

With this control, even when the printing is executed in the input page order of case 5, occurrence of a defective print page is prevented.

As has been described above, according to the embodiment of the present invention, in the case where the obverse page is a color page, the 2-sheet-first-input alternate circulation is prohibited, and 1-sheet circulation is executed. Thereby, printing can be performed without thermal effect from the fixing device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus which is allowed to form images on obverse and reverse surfaces of a sheet, respectively, and eject the sheet, with an odd-numbered page thereof located as the reverse surface, comprising:

means for transferring a toner image on a sheet material;

means for fixing the toner image on the sheet material;

means for holding the sheet material on which the toner is fixed, the holding means allowed to hold at least two sheet materials on which respective toner images are fixed;

means for conveying the sheet material on which the toner image is fixed, at predetermined timing, to thereby enable the means for transferring to transfer another toner image to a surface of the sheet material where no toner image is fixed;

means for confirming whether monochromatic image formation or color image formation is to be executed based on image data; and means for controlling, when the confirming means confirms that the monochromatic image formation is to be executed, such that a toner image to be transferred to an even-numbered page of a subsequent sheet material based on image data is transferred to the even-numbered page thereof, wherein the controlling means determines whether the sheet material on which the toner image is fixed is to be guided to the holding means or not, based on an order in which at least one of the monochromatic and color image formation is to be performed for each of the pages, the order being indicated by the image data referred to by the confirming means, and wherein the controlling means guides the sheet material on which the toner image is fixed to the holding means when, according to the order, the color image formation is not to be performed with respect to all pages, and wherein when according to the order, the monochromatic image formation is to be performed on odd-numbered pages and even-numbered pages of all the sheet materials, the controlling means expands image data of 6 pages as a set of image data such that toner images for the pages are allowed to be output in the order of the toner image for the even numbered page of the sheet material on which the toner image is fixed, the toner image for the even-numbered page of the subsequent sheet material, the toner image for the odd-numbered page of the sheet material on which the toner image is fixed, the toner image for the even-number page of the further subsequent sheet material, the toner image for the odd-numbered page of the subsequent sheet material, and the toner image for the odd-numbered page of the further subsequent sheet material.

2. An image forming method for an image forming apparatus which is allowed to form images on obverse and reverse surfaces of a sheet, respectively, and eject the sheet, with an odd-numbered page thereof located as the reverse surface, the image forming method comprising:

confirming whether monochromatic image formation or color image formation is to be executed, based on image data; and performing, when it is confirmed that the monochromatic image formation is to be executed, a control such that a toner image to be transferred to an even-numbered page of a subsequent sheet material based on image data is transferred to the even-numbered page thereof, wherein, in the performing the control, when according to the order, the monochromatic image formation is to be performed on odd-numbered pages and even-numbered pages of all the sheet materials, image data of 6 pages is expanded as a set of image data such that toner images for the pages are allowed to be output in the order of the toner image for the even numbered page of the sheet material on which the toner image is fixed, the toner image for the even-numbered page of the subsequent sheet material, the toner image for the odd-numbered page of the sheet material on which the toner image is fixed, the toner image for the even-number page of the further subsequent sheet material, the toner image for the odd-numbered page of the subsequent sheet material, and the toner image for the odd-numbered page of the further subsequent sheet material.

* * * * *